US006663032B2

(12) United States Patent
Helton

(10) Patent No.: US 6,663,032 B2
(45) Date of Patent: Dec. 16, 2003

(54) MULTI-SEGMENT ROLL PACKAGE

(75) Inventor: Kennith H. Helton, Gainesville, GA (US)

(73) Assignee: Tricon, Inc., Lula, GA (US)

( * ) Notice: Subject to any disclaimer, the term of this patent is extended or adjusted under 35 U.S.C. 154(b) by 0 days.

(21) Appl. No.: 10/323,031

(22) Filed: Dec. 18, 2002

(65) Prior Publication Data

US 2003/0089807 A1 May 15, 2003

Related U.S. Application Data

(62) Division of application No. 09/843,012, filed on Apr. 26, 2001, now Pat. No. 6,595,448.

(51) Int. Cl.[7] ..... B65H 18/28
(52) U.S. Cl. ..... 242/160.2; 242/167
(58) Field of Search ..... 242/160.2, 167, 242/531, 531.1, DIG. 2; 206/391, 393, 394

(56) References Cited

U.S. PATENT DOCUMENTS

| | | | |
|---|---|---|---|
| 4,477,035 | A | 10/1984 | O'Connor |
| 4,568,033 | A | 2/1986 | O'Connor |
| 4,603,817 | A | 8/1986 | O'Connor |
| 6,209,814 | B1 | 4/2001 | Helton |

*Primary Examiner*—John Q. Nguyen
(74) *Attorney, Agent, or Firm*—Kenneth S. Watkins, Jr

(57) ABSTRACT

A multi-segment roll package comprises a continuous length of plastic tape [117] wound about a core [105] resulting in a center spooled roll segment [109] sandwiched between two end spooled portions [400A, 400B]. In one embodiment, the end spooled portions comprise a helical pitch [403] less than the pitch [211] of the center spooled segment. In a second embodiment, the end spooled portion [400B] comprises a helical pitch [407} greater than the pitch of the center spooled segment and comprises more layers with a reversed helical pitch than the center spooled roll segment.

9 Claims, 4 Drawing Sheets

113
115
108
113
115
113
110
110
103
117
101
116
107B
109C
109B
109A
115A
121
109
210
2
2
SEE FIG. 1B
SEE FIG. 1A
107A
114
105
111

MULTI-SEGMENT ROLL PACKAGE

This is a divisional of application Ser. No. 09/843,012, filed Apr. 26, 2001, now U.S. Pat. No. 6,595,448.

BACKGROUND OF THE INVENTION

The present invention relates to winding and, more particularly, to winding tape on cores to build roll packages of tape.

Tape, especially plastic tape, has become commonplace in a number of products including electrical products such as wire, cable, conduit, transformers and other electrical components, general purpose tapes and packaging. The use of plastic tape as ties in plastic garbage and storage bags has grown significantly. Manufacturers utilize plastic tape in the form of rolls in automated machinery to produce a wide range of such products.

Rolls of plastic tape are normally wound on cores to aid in winding and provide improved stability of the roll. They are sometimes wound as a single "pancake" package which comprises a single roll having a width equal to the width of the plastic tape or film. Such a roll has the disadvantage of becoming unstable at large roll outer diameters, especially if the tape is narrow. The single roll package also limits the length of plastic tape, requiring frequent stopping of the machinery for roll changes.

Another winding method for roll packages utilizes a spool package that employs a continuous helical winding that alternates in direction similar to winding a reel of fishing line or string. This method produces a roll package with a width greater than the tape width and provides additional capacity of the roll package as compared to the "pancake" roll package. This method results in a condition of "soft" ends resulting from voids between the windings at the roll ends caused by the helical pattern. This winding method suffers the disadvantage of instability, and limits the diameter to which the roll package may be wound. Use of spools with end discs improves the stability, but increases the complexity, cost and weight of the package.

U.S. Pat. No. 4,568,033 discloses a tape package comprising a winding method which incorporates a flanged portion and a central helical traverse portion. The wind portions are built up from a plurality of windings to form steps. The height of the step is limited by the ability of the tape to traverse the steps. U.S. application Ser. No. 09/370,677 hereby incorporated by reference, discloses a multi-segment roll package that utilizes a novel pattern of end, center and intermediate roll segments made up of winding groups separated by helical transition windings.

OBJECTS AND SUMMARY OF THE INVENTION

Therefore, an object of the present invention is to provide a roll package having a high wrapping density, increasing the length of tape in a given package outer diameter.

A further object of the present invention is to provide a roll package that may be wrapped to larger roll diameters, increasing the capacity of the roll package.

A further object of the present invention is to provide a roll package with improved mechanical stability, reducing the reject rate of roll packages due to damage.

Yet another object of the present invention is to provide a roll package that combines the advantages of the simple spooled roll package and the high-density multi-segment roll packages of earlier designs.

The roll package of the present invention includes a continuous length of tape wrapped as a conventional spooled roll segment sandwiched between two outer or end roll segments. The end roll segments and the spooled roll segment are wrapped on a common core and share a common winding axis. The end roll segments are built up from spiral winding groups of one or more zero-pitch spiral windings interrupted or separated by helical transition windings which transition to and from the spooled roll segment. The helical pitch of the transition windings is greater than the helical pitch of the spooled roll segment. The spooled roll segment is built up from layers of helical spool windings of a predetermined pitch. In the preferred embodiments, the spooled roll segment is at least two tape widths wide. The end segments are substantially one tape width wide.

In the preferred embodiments, the helical pitch of the transition windings is greater than the tape width. A high transition winding pitch, greater than the spool pitch of the center spooled roll segment, aids in transitioning the "step" or difference in height created during the build-up of the segments. The high transition winding pitch reduces humps or distortions that would otherwise result.

In the preferred embodiments, the roll package is made by wrapping one or more spiral windings at the first end segment position, wrapping a helical transition winding to the beginning of the spooled roll segment, wrapping a layer of helical spool windings at a spool pitch to the end of the spool roll segment position, wrapping a helical transition winding to the second end segment position and wrapping one or more spiral windings at the second end segment position. The axial direction of the windings is then reversed and the wrappings of spooled and end windings are repeated to the first end in a similar manner. The process is repeated until the roll package is wrapped to the desired diameter.

A second embodiment of the roll package incorporates one or more intermediate roll segments disposed between the spooled roll segment and the end segments. The intermediate roll segment is similar to the end roll segment except that the relative number of spiral windings in each winding group is approximately one half of the end roll segments. Helical transition windings connect the intermediate winding groups to the end winding groups and the spooled winding layers.

Yet another embodiment of the roll package incorporates an end spool portion made up of a plurality of wrappings with an end pitch different than spool pitch 211.

The high-pitch helical transition windings act as connectors between the end roll segments and the spooled roll segment or the end roll segments, intermediate roll segments and spooled segments. The combined structure results in a package which eliminates the "soft end" problems of a conventional spooled roll package and allows larger diameter packages than would be practical with conventional spooled packages.

BRIEF DESCRIPTION OF THE DRAWINGS

These and other features, aspects and advantages of the present invention will become better understood with regard to the following description, appended claims and accompanying drawings where:

FIG. 3A is a detail end view of the end roll segment showing the end spiral winding groups similar to those of FIG. 1A; and FIG. 3B is a detail end view of the intermediate roll segment showing the intermediate spiral winding groups defined by spiral windings separated by helical transition windings.

DESCRIPTION OF THE PREFERRED EMBODIMENTS

The following is a description of the preferred embodiments of a multi-segment roll package of a continuous length tape and a method for making the package.

Figures 1, 1A, 1B:
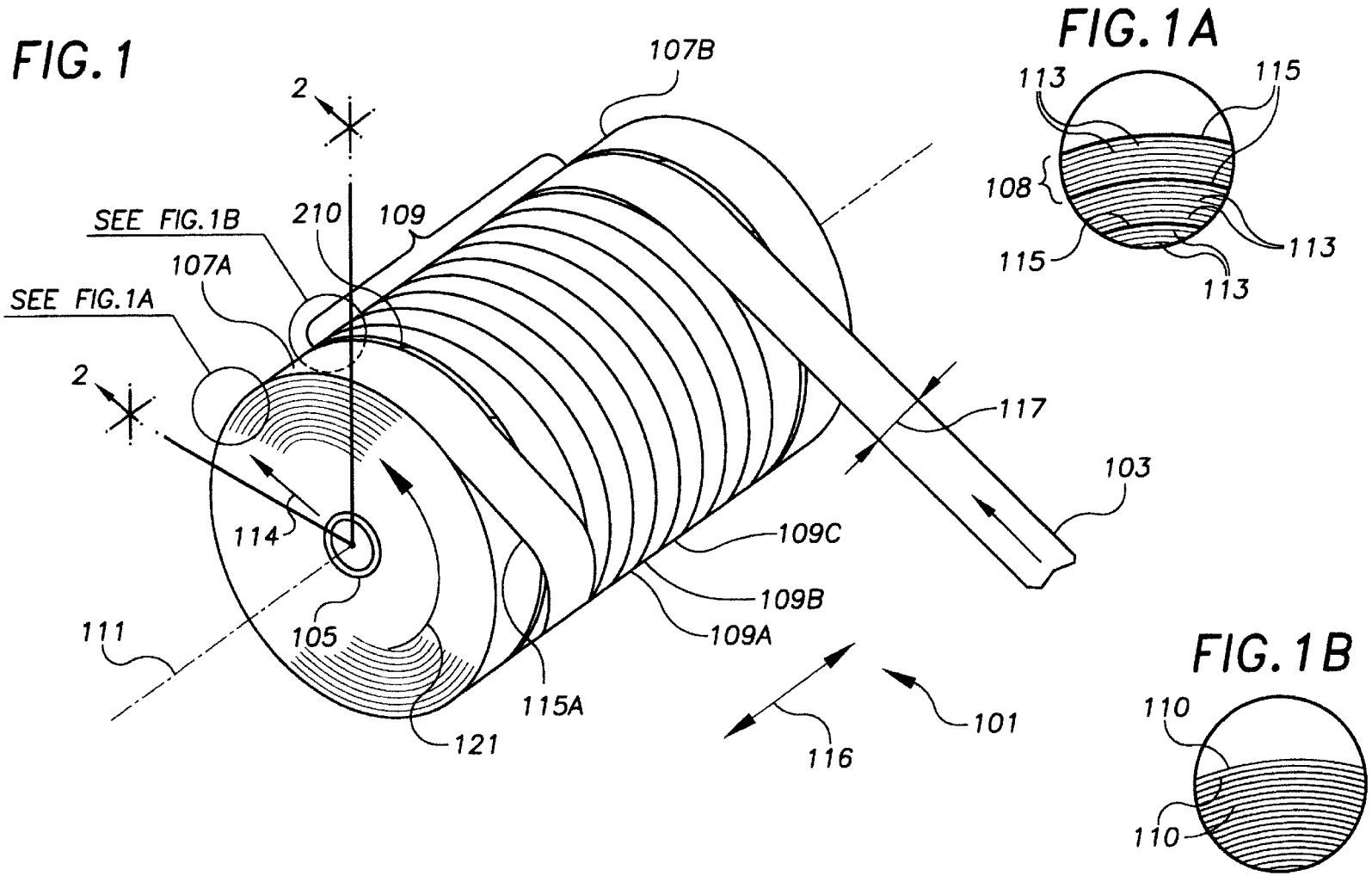
FIG. 1 is a perspective drawing of a multi-segment roll package having two end roll segments made up of spiral winding groups and a spooled roll segment made up of helically wrapped layers.
FIG. 1A is a detail end view of one end roll segment showing spiral windings making up the spiral winding groups, the spiral winding groups separated by helical transition windings.
FIG. 1B is a detail end view of the spooled roll segment showing spooled winding layers making up the spooled roll segment.

FIG. 1 is a perspective drawing of embodiment 101 of a multi-segment roll package comprising a continuous length of plastic tape 103 wrapped on core 105. Package 101 is made up of end roll segments 107A and 107B, and spooled roll segment 109 disposed between roll segments 107A and 107B. End roll segments 107A and 107B and spooled roll segment 109 comprise a common longitudinal roll segment axis 111.

End roll segments 107A and 107B are made up of a plurality of end spiral winding groups 108, shown in detail FIG. 1A. Each end winding group consists of at least one spiral winding such as windings 113 separated by helical transition windings 115. Spiral windings 113 are wrapped spirally about roll axis 111 and, in the preferred embodiments, have substantially no (zero) helical pitch associated with them. For the purpose of this disclosure, helical pitch is defined as the axial length 116 the tape is displaced per revolution of the winding.

The helical transition windings have a significant helical pitch associated with the windings in order to transition to the adjacent segment, increase the stability of the package structure and to reduce humps or distortions between the roll segments as discussed later in this specification.

Spooled roll segment 109 comprises a substantially constant helical pitch to produce a plurality of consecutive helical spool windings 109A, 109B, 109C which are axially displaced from each other by an amount depending on the magnitude of the helical spool pitch.

In the preferred embodiments, spooled roll segment 109 is a conventional spooled portion built up from a plurality of helical spool windings such as windings 109A, 109B, 109C of FIG. 1. Resulting layers 110 of spool windings are shown in FIG. 1B. In the preferred embodiments, the helical pitch of the spool windings is less than the pitch of the helical transition portions, and in the preferred embodiments, the pitch of the spool windings is less than tape width 117, resulting in overlapped spooled segment windings shown in FIG. 1 and FIG. 2.

Figure 2:
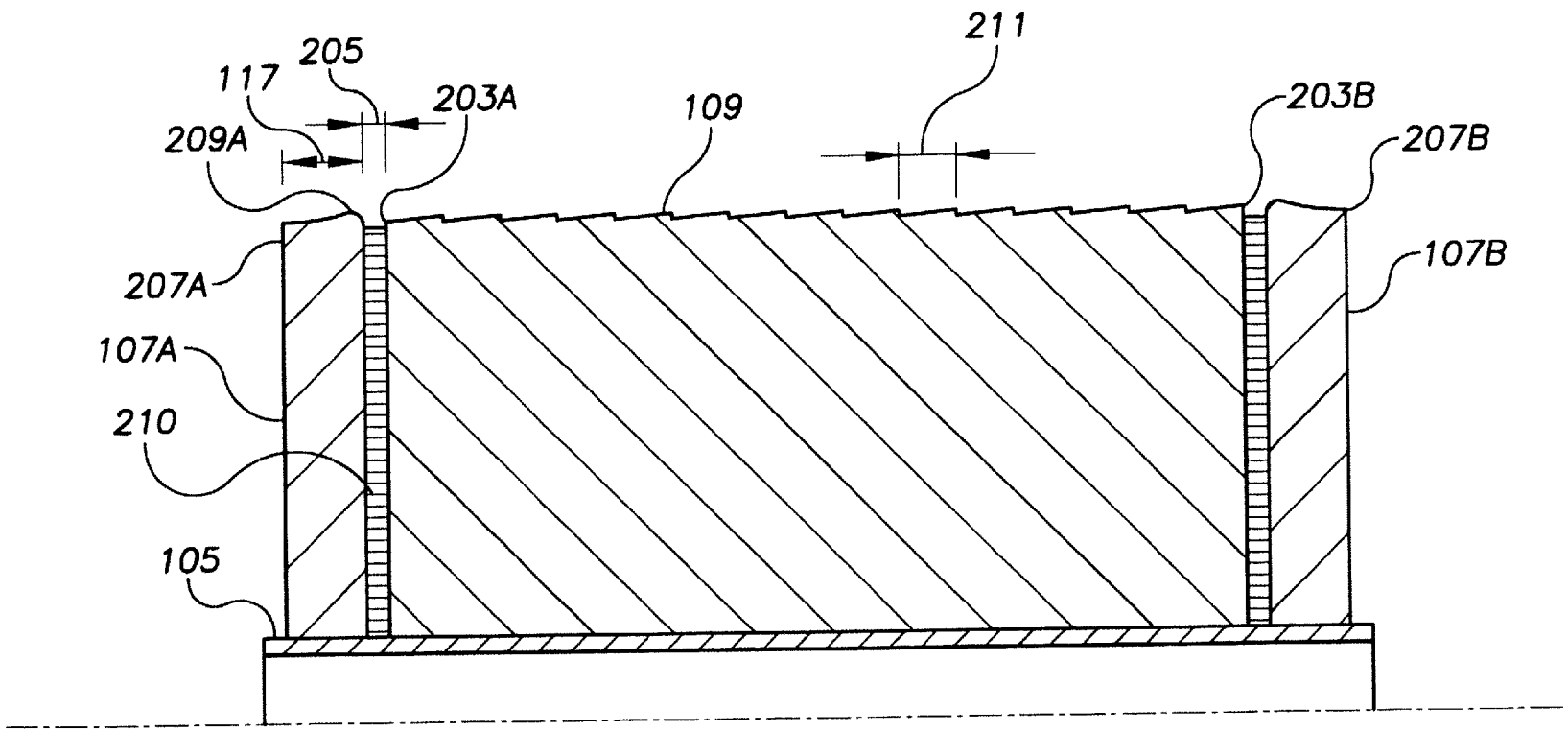
FIG. 2 is a partial cross section of the roll package taken along lines 2—2 of FIG. 1 showing the hump on the outside roll segments caused by the helical transition windings and the overlap of windings on the spooled roll segment.

FIG. 2 is a partial cross section of the roll package taken along lines 2—2 of FIG. 1. Building the roll package of FIG. 1 and FIG. 2 starts with wrapping at least one spiral winding at a starting point on core 105 such as the end segment 107A position. Core 105 is rotated in direction 121 of FIG. 1 by a winding machine to wind a predetermined number of spiral windings 113 in radial direction 114. A tape guide means, such as a tape guide of a winding machine then axially positions tape 103 during rotation of core 105 to transition tape 103 to the beginning of spooled roll segment 109 position to produce a helical transition winding such as winding 115A of FIG. 1. The term tape guide in this specification includes any means of changing the relative axial position of the tape to the roll package, such as the tape guide means of the winding machine disclosed in U.S. Pat. No. 6,007,016, hereby incorporated as a reference. The relative axial positioning rate or speed of the tape guide to the rotational speed of the winding machine defines a helical transition winding pitch of the winding.

The tape guide continues the axial positioning at the helical transition winding pitch until the outside (trailing) edge of tape 103 transitions to the beginning of spooled roll segment 109 position (203A of FIG. 2). This position is defined by the tape width 117 plus the segment spacing 205. In the preferred embodiments, segment spacing 205 is less than 0.5 times tape width 117, and in the more preferred embodiments, spacing 205 is less than 0.25 times tape width 117. In the most preferred embodiments, spacing 205 is 0.05 to 0.2 times tape width 117.

The tape guide then begins a spool winding layer (110 of FIG. 1B) by axially positioning tape 103 at a second rate relative to rotational speed of the winding machine to define a spool winding pitch. The tape guide continues the spool transition at the spool winding pitch until the leading edge of tape 103 reaches the end of spooled roll segment 109 (position 203B of FIG. 2). The tape guide then increases the pitch to the helical transition winding pitch until the leading edge of tape 103 reaches the outside of end segment 107B position (207B of FIG. 2). The tape guide holds this position, wrapping at least one winding or turn at end roll segment 107B before reversing direction. In the preferred embodiments, the segment spacing between spooled roll segment 109 and end roll segment 107B is the same as segment spacing 205.

In the preferred embodiments, the tape guide transitions or guides tape 103 back to spooled roll segment 109 in the reversed direction at the helical transition winding pitch until the trailing edge of tape 103 reaches the end of spooled segment 109 (position 203B), upon which time the tape guide slows to the spool winding pitch until the leading edge of tape 103 reaches spooled roll segment 203A position. The tape guide then speeds to the helical winding transition pitch until the leading edge of tape 103 reaches end 207A of end segment 107A. The tape guide remains stationary to wind at least one winding at end roll segment 107A position and the process repeats as described.

In the preferred embodiments, the helical transition pitch is greater than 0.5 times the tape width 117, in the more preferred embodiments the helical pitch of the helical transition windings is greater than 1.0 times the tape width, and in the most preferred embodiments, the helical pitch of the helical transition windings is greater than 1.5 or 2.0 times the tape width. For tapes of reduced thickness, or of high elasticity, the helical transition winding pitch may be greater than 3, 4, or 6 times the tape width. The helical transition windings form connection "bridges" 210 directly between end roll segments and spooled roll segment 109. These bridges add stability to the roll segments and allow larger diameter roll packages.

A relatively high helical pitch during the helical transition winding portion of the wrapping is important for several reasons. First, the axial transition from the end roll segments to the spooled roll segment means that more tape is wound on the inside of the end roll segments relative to the outside of the end roll segments. This difference in tape building results in a rise or hump 209A on the inside of the end roll segment. It is desirable to reduce the magnitude of hump 209A by increasing the pitch of the helical transition winding to reduce the added tape on the inside of the end roll segments. Also, the tape has a tendency to follow the "convex" portion of the roll package formed by hump 209A, and increasing the helical pitch of the helical transition winding allows the guide to force the tape over the distortion of hump 209A to the desired position.

In the preferred embodiments, spool pitch (shown by 211 of FIG. 2) of spooled roll segment 109 is less than the tape width resulting in overlap of the windings. In the more preferred embodiments, the helical pitch of the spool windings is less than 0.5 times the tape width, and in the more preferred embodiments, the helical pitch of the spool windings is between 0.2 to 0.5 times the tape width. In still other embodiments, the helical pitch of the spool windings is less than 0.2 or less than 0.1 times the tape width. The spool pitch 211 is adjusted depending on the number of spiral windings of the end roll segments in order to produce a generally cylindrical roll package without excessive concave or convex shape to the package.

In a variation of this embodiment, two or more layers 110 of helical windings may be applied to the spooled roll segment before transitioning to an end roll segment. The spool pitch and number of spiral windings in the end spiral winding groups 108 may be adjusted to provide the desired package shape.

Figure 3:
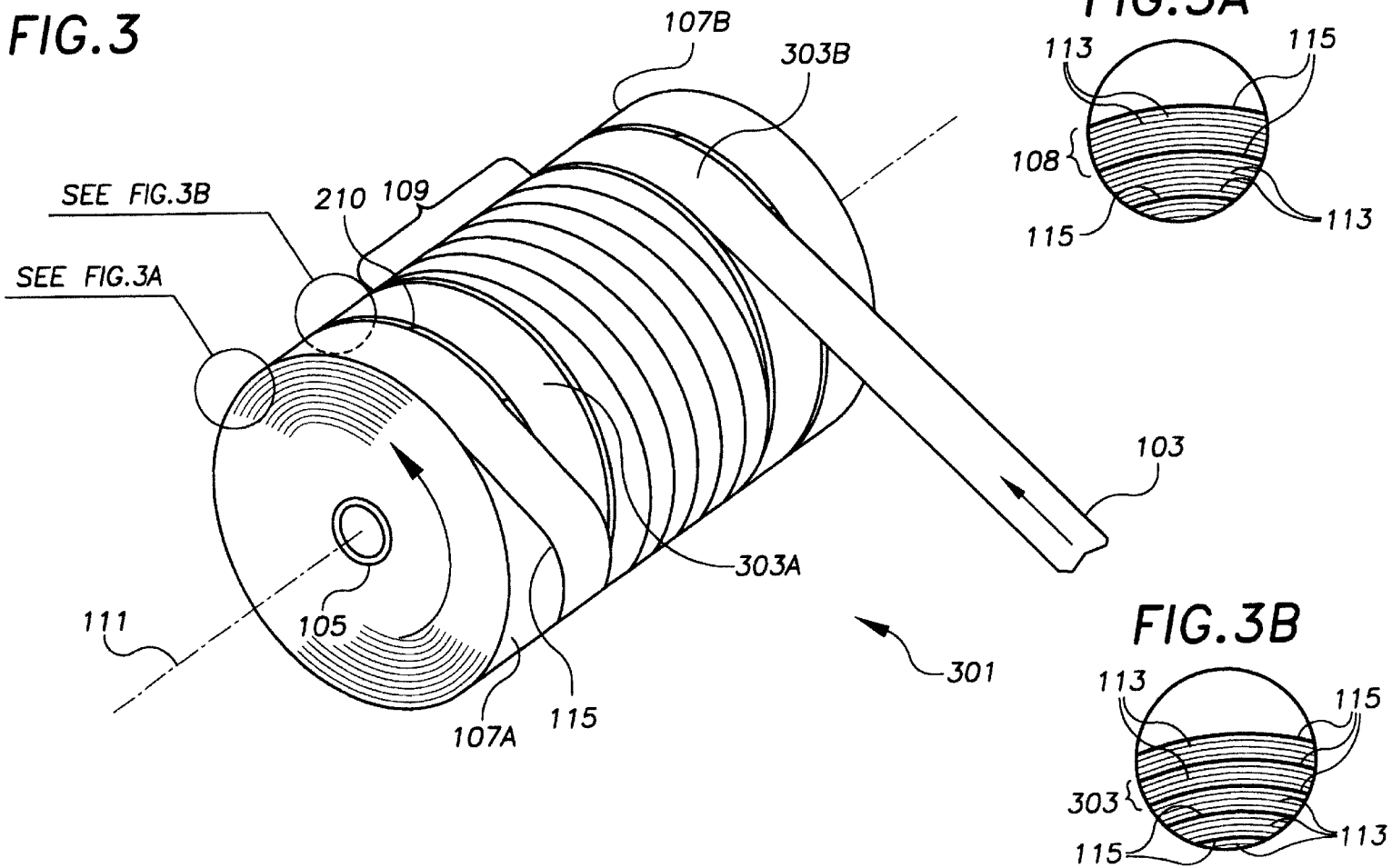
FIG. 3 is a perspective drawing of an embodiment of the roll package of the present invention comprising two intermediate roll segments comprising spiral winding groups in addition to the end roll segments and spooled roll segment of the embodiment shown in FIG. 1.

FIG. 3 is a perspective drawing of embodiment 301 of a roll package employing two end roll segments, 107A and 107B, two intermediate roll segments 303A and 303B, and a spooled roll segment 109. End roll segments 107A and 107B and spooled roll segment 109 are similar to those in the embodiments of FIG. 1 and FIG. 2.

Intermediate roll segments 301A and 301B are made up of spiral windings 113 separated by helical transition windings 115 to form intermediate spiral winding groups (303 of FIG. 3B) similar to end spiral winding groups 108 of end roll segments 107A and 107B. In the preferred embodiments, intermediate spiral winding groups comprise approximately half the number of windings as end spiral winding groups 108 since the intermediate roll segments are "visited" twice each time the end roll segments are visited. The spacing between the end roll segments and the intermediate roll segments is similar to spacing 205 of FIG. 2.

The addition of intermediate roll segments 303A and 303B improves the end stability of the package. In the preferred embodiments, the roll package is built up by winding the first end spiral winding group at position 107A, winding a helical transition winding 115 to intermediate roll segment 303A position and winding one half the number of spiral windings 113 as the end spiral winding group, winding a helical transition winding 115 to spooled roll segment 109 position, winding a layer of helical spool windings at the spool pitch to the end of the spooled roll segment, winding a helical transition winding 115 to intermediate roll segment 303B position and winding an intermediate spiral winding group, winding a helical transition winding 115 to end segment position 107B and winding an end spiral group. At this point, the tape guide would reverse and the process repeated. The spool pitch of the spooled roll segment windings may be adjusted to provide the desired package shape.

In a variation of this embodiment, two or more layers or "visits" of helical windings may be applied to the spooled roll segment before transitioning to an intermediate roll segment. The spool pitch and number of spiral windings in the intermediate spiral winding groups 303 may be adjusted to provide the desired package shape. Likewise, the number of visits of the intermediate roll segments may be varied in relation to the number of end roll segment visits from the normal ratio of 2 as disclosed in U.S. application Ser. No. 09/370,677, hereby incorporated by reference. The relative number of windings in the intermediate winding groups and the end winding groups may be adjusted to maintain the desired roll shape.

Figure 4:
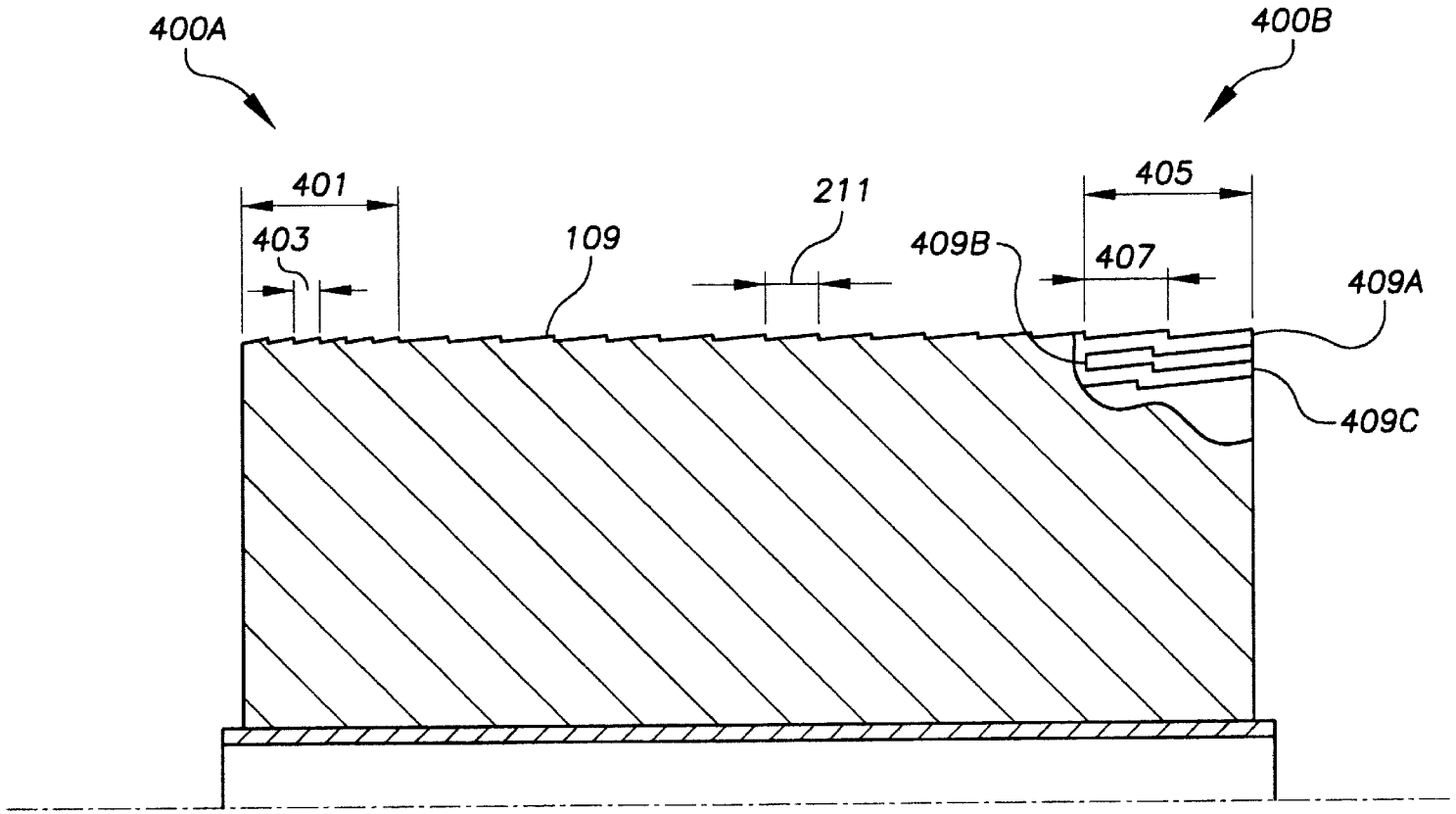
FIG. 4 is a partial cross section of an alternative embodiment of the roll package having an end spool portion with a no-zero helical pitch less than the spool pitch of the center portion, and another embodiment having an end spool portion having three or more winding direction reversals between subsequent layers of the center spooled portion.

Still other embodiments of the modified spool roll are shown in FIG. 4. The end treatment of embodiment 400A utilizes an end spool portion 401 made up of a plurality of wrappings with an end pitch 403 less than spool pitch 211. End portion 401 has a width greater than tape width 117 of FIG. 1. In the preferred embodiments, end portion 401 is at least two tape widths and end pitch 403 is less than tape width 117. In the more preferred embodiments, end pitch 403 is less than 0.75 times tape width 117. In the still more preferred embodiments, end pitch 403 is less than 0.5 times tape width 117.

The end treatment of embodiment 400B utilizes an end pitch 407 equal to, or greater than, spool pitch 211. The tape guide may be reversed two or more times within end portion 405 to produce more wrapped layers with a reversed helical pitch in end portion 405 as compared to center spooled portion 109. This is shown schematically at end 400B as end spool pitch reversals 409B and 409C after the pitch reversal 409A which normally occurs in a spooled portion.

Accordingly the reader will see that the MULTI-SEGMENT ROLL PACKAGE FOR PLASTIC TAPE disclosed and claimed provides an improved roll package for plastic tape. The roll package provides the following additional advantages:

The roll package density is high, increasing the length of tape on a given size roll package as compared to conventional spooled roll packages, reducing converting roll change time and shipping costs;

The end roll segments increase the stability and decrease the softness of the package ends as compared to conventional spooled roll packages;

The roll package is stable, reducing roll package damage and waste;

Larger package diameters may be wound, reducing converting equipment change time and shipping costs; and The roll package is simple to make and use.

Although the description above contains many specifications, these should not be construed as limiting the scope of the invention but as merely providing illustrations of some of the presently preferred embodiments of this invention. For example, in some embodiments, all of the winding groups meet the relative winding number specifications in this disclosure. In other embodiments, the majority, or at least a substantial number of, the winding groups meet the relative winding number specifications. In other embodiments, one or more helically-wound "wrapping layers" are wound over all of the roll segments to provide a protection and a stabilizing cover for the roll package. In still other embodiments, core 105 is a temporary core used for the wrapping process only.

The process may be used for tapes other than plastic, such as paper tapes and fabric tapes. The wrapping process may start in the spooled roll segment or intermediate roll segment instead of an end roll segment. Deviation of the relative group winding numbers or frequency of visits for a portion of the total roll segment wind does not depart from the spirit of the invention, that is to combine roll segments utilizing groups of spiral windings and conventional spooled roll segments to increase the stability and package roll diameter as compared to conventional spooled roll packages.

Thus the scope of the invention should be determined by the appended claims and their legal equivalents, rather than by the examples given.

I claim:

1. A spooled roll package of plastic tape comprising:

a first spooled portion comprising layers of said plastic tape wrapped in layers comprising a first spooled helical pitch; and a second spooled portion comprising a second spooled portion width greater than a width of said plastic tape and comprising a second spooled helical pitch less than said first spooled helical pitch.

2. The roll package of claim 1 wherein said second spooled portion width is at least two times said width of said plastic tape.

3. The roll package of claim 2 wherein said second spooled helical pitch is less than 0.75 times said width of said plastic tape.

4. The roll package of claim 2 wherein said second spooled helical pitch is less than 0.5 times said width of said plastic tape.

5. A spooled roll package of plastic tape comprising:

a first spooled portion comprising layers of said plastic tape wrapped in layers comprising a first spooled helical pitch greater than zero; and a second spooled portion comprising a second spooled portion width greater than a width of said plastic tape and comprising a second spooled helical pitch at least equal to said first spooled helical pitch;

wherein said second spooled portion comprises at least two pitch reversals between successive layers of said first spooled portion.

6. The roll package of claim 5 wherein said second spooled portion width is at least two times said width of said plastic tape.

7. The roll package of claim 6 wherein said second spooled helical pitch is greater than said first spooled helical pitch.

8. A spooled roll package of plastic tape comprising:

a first spooled portion comprising layers of said plastic tape wrapped in layers comprising a first spooled helical pitch greater than zero; and an end spooled portion comprising a width greater than a width of said plastic tape and comprising a second spooled helical pitch greater than said first spooled helical pitch.

9. The spooled roll package of claim 8 wherein said end spooled portion comprises at least two pitch reversals between successive layers of said first spooled portion.

* * * * *